United States Patent [19]

Zeleny

[11] 4,250,931

[45] Feb. 17, 1981

[54] GUIDE FOR A WEFT-PICKING MEANS

[75] Inventor: Klaus P. Zeleny, Konstanz, Fed. Rep. of Germany

[73] Assignee: Sulzer Brothers Limited, Winterthur, Switzerland

[21] Appl. No.: 16,483

[22] Filed: Mar. 1, 1979

[51] Int. Cl.[3] ..... D03S 51/40

[52] U.S. Cl. ..... 139/341; 139/370.2

[58] Field of Search ..... 139/336, 341, 342, 370.1, 139/370.2

[56] References Cited

U.S. PATENT DOCUMENTS

| | | | |
|---|---|---|---|
| 3,613,742 | 10/1971 | Ainsworth et al. | 139/341 |
| 4,031,924 | 6/1977 | Domig et al. | 139/341 |

FOREIGN PATENT DOCUMENTS

| | | | |
|---|---|---|---|
| 2758402 | 7/1978 | Fed. Rep. of Germany | 139/370.2 |
| 1518599 | 2/1968 | France | 139/370.2 |

*Primary Examiner*—Henry Jaudon

*Attorney, Agent, or Firm*—Kenyon & Kenyon

[57] ABSTRACT

The transducer for sensing the position of a weft picking means in the picking path is mounted in a recess of one of the guide teeth guiding the picking means. The transducer is a piezo-electroacoustic transducer. The transducer may also be mounted on an exterior surface of the guide tooth and may be of a different type, e.g. a strain gauge. Other transducers can be mounted on other guide teeth to control different machine operations.

10 Claims, 1 Drawing Figure

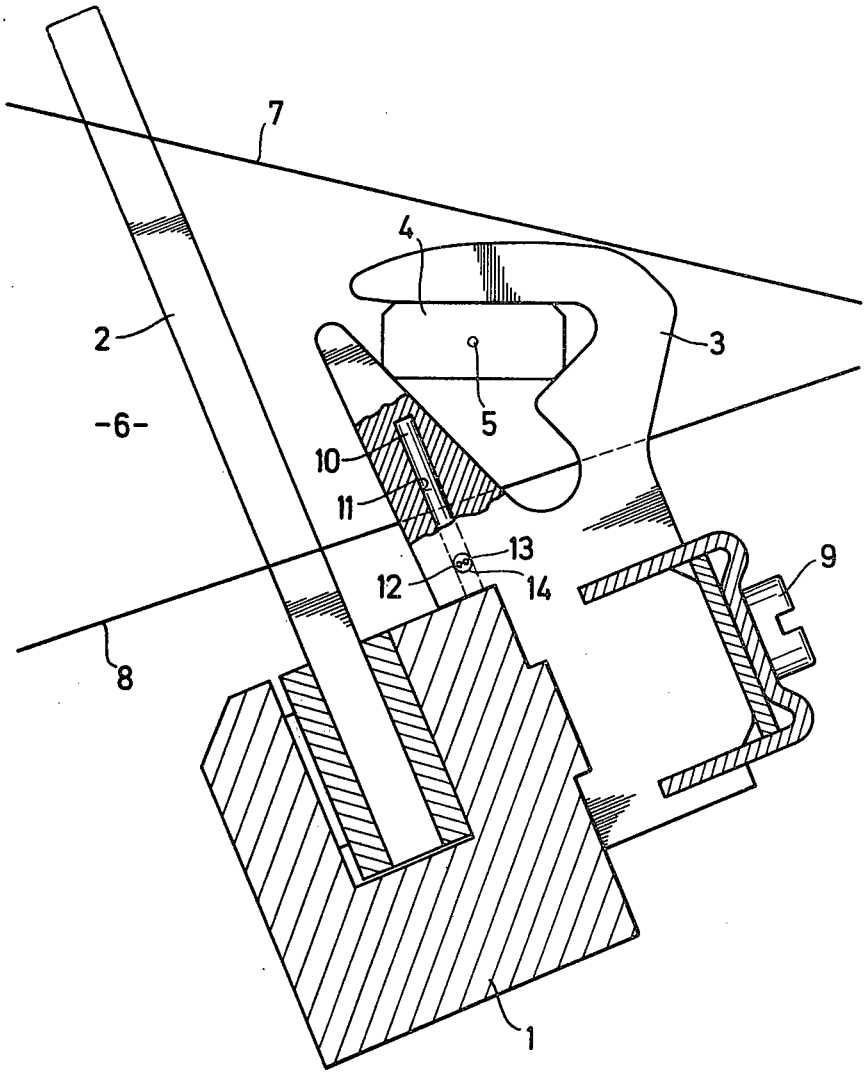
7
4
2
3
-6-
5
10
11
13
12
14
9
8
1

GUIDE FOR A WEFT-PICKING MEANS

This invention relates to a guide for a weft-picking means. More particularly, this invention relates to a guide for a weft-picking means in a weaving machine.

As is known various types of weaving machines employ guides for guiding a weft-picking means through a picking path. In some cases, transducers are employed to generate signals in dependence upon the movement of the weft-picking means through the picking path for various purposes. For example, the signals can be used to determine whether the time when the picking means, such as a gripper projectile, will reach a particular zone of the weaving machine, such as a catcher zone, corresponds to a specified zone of the angular position of the main shaft of the machine at that time. If the required agreement does not apply, a switching unit can be activated to stop the weaving machine.

A known transducer for this purpose operates inductively and is disposed at a specific distance in front of the weaving machine catcher zone and above the projectile path. In order to ensure a strong inductive coupling with clear signals capable of evaluation, the projectile must be ferrogmagnetic and the inductive transducer must be a small distance from the ferromagnetic projectile. This is not always possible to achieve easily. If a plastic projectile is used, of which only the core is ferromagnetic, this requirement is still more difficult.

Accordingly, it is an object of the invention to provide a weaving machine of the above type with a transducer which is situated a very short distance from the projectile path.

It is another object of the invention to provide a relatively simple arrangement for sensing the presence of a weft-picking means at a given point in a picking path.

Briefly, the invention provides a guide for a weft-picking means which comprises a plurality of guide teeth for guiding a picking means in a picking path and a transducer mounted on at least one of the guide teeth for generating a signal in dependence on the movement of the weft-picking means through the guide tooth.

Preferably, the transducer is a piezo-electroacoustic transducer which is accomodated in a recess of the guide element. The transducer may also be of other types such as a strain gauge and can be mounted on an exterior surface of a guide tooth.

These and other objects and advantages of the invention will become more apparent from the following detailed description taken in conjunction with the accompanying drawing which illustrates a partial cross-sectional view of a guide tooth with a transducer disposed therein according to the invention.

Referring to the drawing, the guide for a weft-picking means is comprised of a plurality of guide teeth 3 (only one of which is shown for clarity) which are disposed in a row on a sley 1 of a weaving machine (not shown) along with a reed 2 in known manner. As indicated the guide teeth 3 serve to guide a weft-picking means, such a gripper projectile, 4 in a picking path from a picking side to a catching side of the weaving machine. During travel through the guide teeth 3, the gripper projectile 4 draws a weft yarn 5 through a shed 6 formed by warp yarns 7, 8 in known manner.

Each guide tooth 3 is fixed to the sley 1 by means of a screw 9 and associated elements as is known for example as described in U.S. Pat. No. 3,556,163.

In order to sense the position of the projectile 4 in the picking path, one of the guide teeth is provided with a transducer 10. As shown, the transducer 10 is a piezo-electroacoustic transducer which is disposed in a recess or bore 11 of the guide tooth. Two electrical leads 12, 13 extend from the transducer 10 through a bore 14 in the guide tooth 3 which is transverse to the recess 11 to the exterior. If the guide tooth 3 is made of metal, the transducer 10 must be electrically insulated by means of an insulating sheath such as a shrink sleeve.

The piezo-electroacoustic transducer 10 consists of a piezo-electric element in a rod or strip form, for example, with electrodes disposed on two opposite sides, e.g. being applied by vapor-coating. In addition, each electrode is provided with a lead 12, 13. The leads 12, 13 run to an amplifier outside the guide which is, in turn, connected to a switching unit (not shown). When the piezo-electric element is mechanically excited by sound pressure (sound waves), the element generates an electrical voltage which is proportional to the amplitude of the sound waves. The sensitivity to acoustic waves is very high so that even a very weak sound level is detected.

The system operates as follows. The gripper projectile 4 travelling through the guide tooth 3 produces sound waves therein as a result of the sound waves radiating therefrom and/or as a result of contact with the guide tooth 3. These sound waves produce acoustic surface waves in the piezo-electroacoustic transducer 10, which mechanically excite the latter so that electrical signals are generated. After amplification, these signals reach the switching unit (not shown) which carries out the required switching operation.

The transducer may be disposed at some other point of the guide tooth 3 than that shown. In addition, of course, more than just one guide tooth 3 may be provided with a transducer, each transducer generating a signal for a different purpose. More particularly, signals can be generated to control the actuation of devices which take part in a weft yarn picking operation, e.g. the weft yarn stop motion, weft yarn brake, and so on.

Also, instead of being accommodated in a recess of a guide tooth 3, the transducer may be mounted on an exterior surface of a guide tooth. In that case, a different transducer, e.g. a strain gauge, can be used instead of the piezo-electricacoustic transducer.

Although the invention has been described in connection with a weaving machine with a gripper projectile, it can also be applied to other weaving machines, e.g. a weaving machine in which a weft bobbin is carried through a shed by a shuttle.

What is claimed is:

1. In a weaving machine having a plurality of guide teeth for guiding a projectile in a picking path, a transducer mounted on at least one of said guide teeth for generating a signal in dependence on the movement of the projectile through said one guide tooth.

2. In a weaving machine as set forth in claim 1, said transducer being a piezo-electroacoustic transducer disposed in a recess in said one guide tooth.

3. In a weaving machine as set forth in claim 2 wherein said transducer includes a piezo-electric element of rod form having electrodes disposed on two opposite sides, said element being mechanically excitable by sound waves.

4. In a weaving machine as set forth in claim 3, an amplifier and a pair of leads, each said lead extending from a respective electrode to said amplifier.

5. In a weaving machine as set forth in claim 1, said transducer being a strain gauge.

6. In a weaving machine as set forth in claim 1 wherein said transducer is responsive to sound waves produced by the travelling projectile to generate an electrical voltage proportional to the amplitude of the sound waves.

7. In a weaving machine as set forth in claim 6 wherein said transducer is a piezo-electroacoustic transducer.

8. In a weaving machine as set forth in claim 1 wherein said transducer is a piezo-electroacoustic transducer consisting of a piezo-electric element having two electrodes thereon, said element being mechanically excitable by sound waves produced by a travlling projectile in said picking path to generate an electrical voltage proportional to the amplitude of the sound waves.

9. A guide for a weft-picking means comprising a plurality of guide teeth for guiding a picking means in a picking path, and a transducer mounted on at least one of said guide teeth for generating a signal in dependence on the movement of the weft-picking means through said one guide tooth.

10. A guide as set forth in claim 9 wherein said transducer is a piezo-electroacoustic transducer consisting of a piezo-electric element having two electrodes thereon, said element being mechanically excitable by sound waves produced by a travelling picking means in said picking path to generate an electrical voltage proportional to the amplitude of the sound waves.

* * * * *